United States Patent [19]

Wilsey

[11] Patent Number: 4,549,345

[45] Date of Patent: Oct. 29, 1985

[54] METHOD OF MAKING A GRAPHITE ZIG-ZAG PICKET HEATER

[76] Inventor: Harvey J. Wilsey, 2602 Bennett St., Sherman, Tex. 75090

[21] Appl. No.: 522,727

[22] Filed: Aug. 12, 1983

Related U.S. Application Data

[62] Division of Ser. No. 323,122, Nov. 19, 1981, Pat. No. 4,410,796.

[51] Int. Cl.[4] ..... H05B 3/00

[52] U.S. Cl. ..... 29/611

[58] Field of Search ..... 29/611, 416; 373/132, 373/118; 219/535, 541, 553

[56] References Cited

U.S. PATENT DOCUMENTS

| | | | |
|---|---|---|---|
| 1,189,725 | 7/1916 | Northrup | 219/422 |
| 2,650,254 | 8/1953 | Kremers | 373/110 |
| 2,931,092 | 4/1960 | Humphrey | 29/416 |
| 2,966,537 | 12/1960 | Witucki et al. | 373/132 |
| 3,004,090 | 10/1961 | Donovan et al. | 373/110 |
| 3,184,530 | 5/1965 | Properzi | 373/110 |
| 3,359,077 | 12/1967 | Arst | 156/619 |
| 3,469,013 | 9/1969 | Hetherington et al. | 373/134 |
| 3,798,007 | 3/1974 | Bochman et al. | 156/619 |
| 3,848,308 | 11/1974 | Kaval | 29/416 |
| 3,860,736 | 1/1975 | Ford | 373/113 |
| 3,971,119 | 7/1976 | Walker | 29/416 |
| 4,038,201 | 7/1977 | Hargreaves | 252/300 |
| 4,158,695 | 6/1979 | Ishizuka | 422/145 |
| 4,238,667 | 12/1980 | Conaway | 219/390 |
| 4,259,278 | 3/1981 | Flegel et al. | 264/81 |
| 4,411,175 | 10/1983 | Takahashi et al. | 29/416 |

FOREIGN PATENT DOCUMENTS

| | | | |
|---|---|---|---|
| 7808508 | 3/1978 | France . | |
| 97907 | 8/1979 | Japan | 219/553 |
| 243928 | 2/1947 | Switzerland . | |
| 420407 | 3/1967 | Switzerland . | |
| 222008 | 9/1924 | United Kingdom . | |
| 231090 | 3/1925 | United Kingdom . | |
| 241256 | 10/1925 | United Kingdom . | |
| 845496 | 8/1960 | United Kingdom . | |
| 939038 | 10/1963 | United Kingdom . | |

*Primary Examiner*—Howard N. Goldberg
*Assistant Examiner*—P. W. Echols

[57] ABSTRACT

A zig-zag picket type graphite heater for use in high temperature furnaces such as are used for crystal growing, for example, is constructed by forming and zig-zag slotting a cylindrical shell-like element. The cylindrical element is then cut into a plurality of like, discrete segments by extending selected ones of the slots through the entire length of the element. Graphite connector elements are then secured between the segments to connect the segments, and also function as connectors to an electric current supply line.

2 Claims, 7 Drawing Figures

METHOD OF MAKING A GRAPHITE ZIG-ZAG PICKET HEATER

The present application is a division of application Ser. No. 323,122 filed Nov. 19, 1981, now U.S. Pat. No. 4,410,796 granted Oct. 18, 1983.

BACKGROUND OF THE INVENTION

The present invention is directed to so-called picket or zig-zag type heater elements employed in high temperature furnaces of the type, for example, used in crystal growing processes. (For examples of furnaces of this type, see U.S. Pat. Nos. 2,650,254; 2,966,537; 3,359,077 and 3,798,077.)

The picket type heating element employed in such furnaces is in the form of a cylindrical shell which surrounds the crucible holding the material to be critically heated. The heater conventionally is machined from a graphite composition into a cylindrical shape with relatively long axially extending slots extending alternately from opposite ends of the cylindrical shell at uniform spacing to each other to provide the "zig-zag" current path.

Particularly in crystal growing operations, the temperatures produced by the heating element must be not only relatively high temperatures, but also extremely uniform in terms of the application of heat to the crucible. Because the element operates as an electrical resistance heater, the heat produced at any given location is directly proportional to the cross-sectional area of current flow. While it is possible to form and machine the heating elements with the necessary degree of precision, the completed graphite heating element is quite brittle and subject to cracking or chipping, even when extreme care is used in handling and cleaning the element. Because a relatively small crack or chip can have an unacceptably deleterious effect upon the uniformity of heating produced by the element, such heating elements, which are very expensive, require frequent replacement.

The present invention is especially directed to a method of making a segmented heater without adversely affecting the heat distribution of the assembled elements.

SUMMARY OF THE INVENTION

In accordance with the present invention, a heating element is constructed by first forming and slotting the cylindrical shell-like element in accordance with conventional practice. The completed element is then cut into a plurality of like segments by extending selected ones of the slots through the entire length of the element. Graphite connector elements are bolted bi-axially with radially extending graphite screws to two adjoining segments to reassemble the segments into cylindrical form, the connector elements also each being provided with an integral lug portion which may be employed as a connector to an electric current supply line for the heater.

Other objects and features of the invention will become apparent by reference to the following specification and to the drawings.

IN THE DRAWINGS

Figure 1:
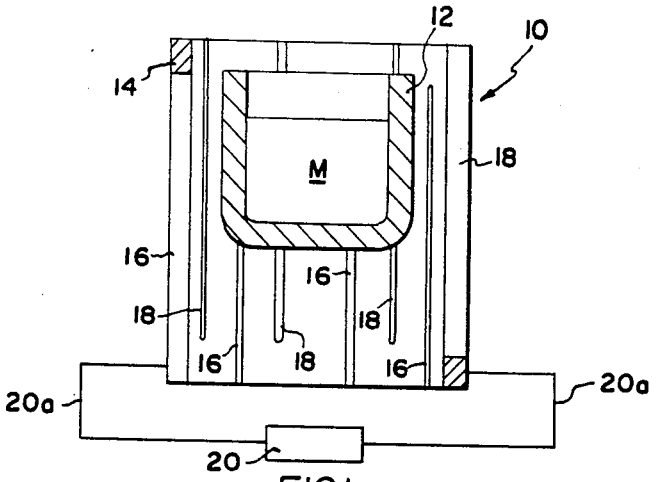
FIG.1 (PRIOR ART)
FIG. 1 is a schematic cross-sectional view of a typical prior art furnace arrangement in which the improved heater of the present invention is to be employed.

The schematic diagram of FIG. 1 is solely for the purpose of indicating a general environment in which the heater of the present invention may be employed. A high temperature furnace is schematically illustrated at 10 and includes a crucible 12 which contains the material M (such as molten silicon) being heated, the crucible being surrounded by a generally cylindrical heater element 14 of the so-called picket type formed from graphite and having axially extending slots 16 and 18 respectively, extending axially from opposite ends of the heater in alternation. The graphite composition used may be that disclosed, for example, in the instant assignee's U.S. Pat. No. 4,259,278 and patents mentioned therein. The heater is electrically connected to a current source 20 by current carrying lines 20*a*. (For a more detailed description of the general environment in which such heaters are used, see, for example, the Arst U.S. Pat. No. 3,359,077 and the Bochman et al U.S. Pat. No. 3,798,007.)

Figure 6:
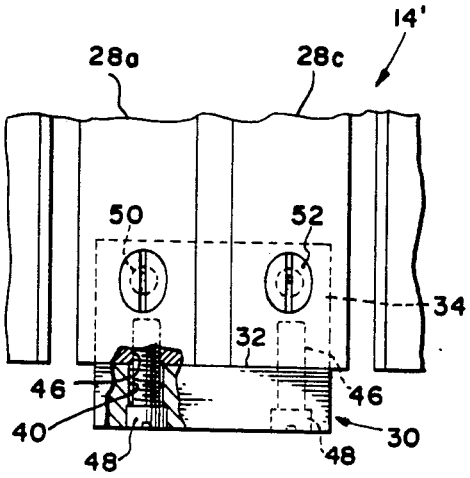
FIG. 6 is a detail side elevational view of a portion of the assembled heater element.
Figure 7:
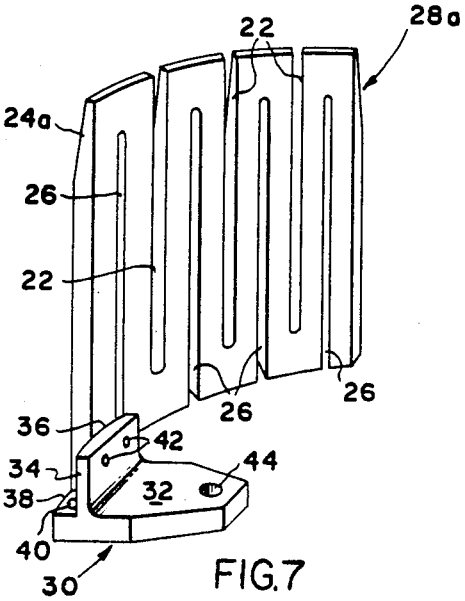
FIG. 7 is a fragmentary, perspective elevational view of the heater with an attached connector.
Figure 2:
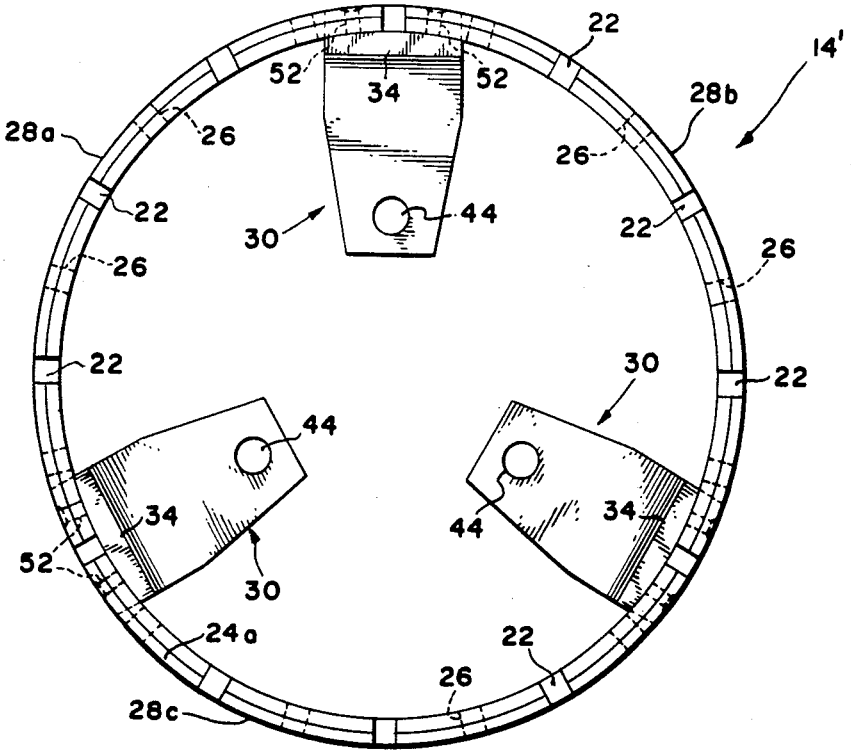
FIG. 2 is an enlarged top plan view of a heater embodying the present invention.
Figure 3:
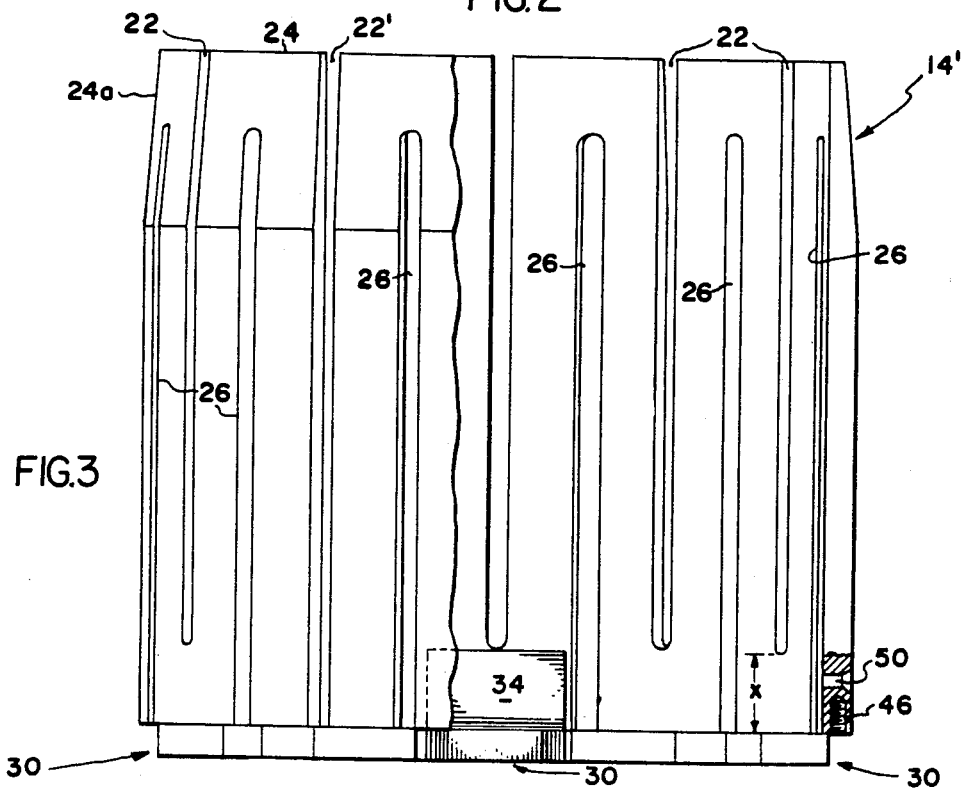
FIG. 3 is a side elevational view of the heater of FIG. 2 with certain parts broken away and shown in section.

The present invention is specifically concerned with an improved form of heater element which is designated generally 14' in FIGS. 2, 3, and 6. As best seen in FIGS. 2 and 3, the overall heater assembly 14' is of a tubular or cylindrical shell-like overall configuration having a first series of slots 22 extending axially downwardly from its top edge 24 (FIG. 3) and a second series of axially extending slots 26 extending axially upwardly from its bottom edge. The equal width slots 22 and 26 are uniformly circumferentially spaced from each other, the axial length of slots 22 is equal to that of slot 26, and, as best seen in FIG. 3, the slots do not extend for the entire axial length of the heater, with an exception to be described below. At its upper end the heater ring is beveled to form a heater upper edge of reduced cross-sectional area as at 24*a*.

The heater element 14' is constructed by first machining a cylindrical blank of graphite to the desired final dimensions of the cylindrical shell and then cutting the slots 22 and 26. Three of the slots 22 are then extended for the full length of the cylindrical heating element at uniformly spaced positions such as 22' (FIG. 2) to separate the cylindrical element into three like cylindrical shell segments 28*a*, 28*b* and 28*c*. The separated segments 28*a*, 28*b* and 28*c* are then reassembled into their original relationship with each other by three graphite connector members designated generally 30, shown in detail in FIGS. 4 and 5. Each of the segments 28*a*, 28*b* and 28*c* has n slots 22 (three in FIG. 2) and n+1 slots 26 (four in FIG. 2).

Figure 4:
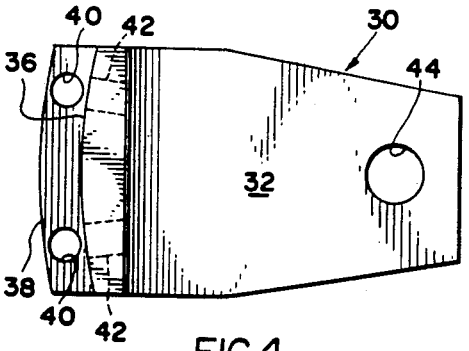
FIG. 4 is a top plan view of a connector element used in the heater of FIG. 2.
Figure 5:
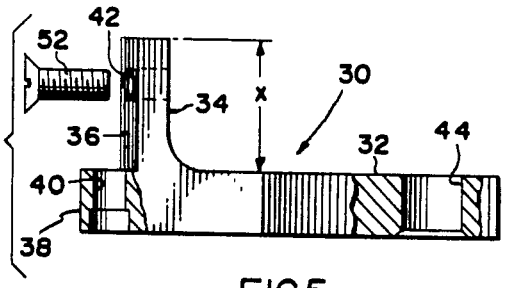
FIG. 5 is a side elevational view of the connector of FIG. 4.

Referring now particularly to FIGS. 4 and 5, each connector element 30 is constructed as a one-piece element from the same graphite material as employed in cylindrical shell segments 28*a*, 28*b* and 28*c*. Each connector element 30 includes a generally flat base 32 having an integral upwardly projecting flange 34. The outer surface 36 of flange 34 is convexly curved to the same radius as the inner diameter of cylindrical shell sections 28*a*, etc., and is spaced inwardly from the outer edge 38 of base 32 by a distance equal to the wall thickness of cylindrical shell sectons 28*a*, etc. A pair of vertical bores 40 extend vertically through the base 32 at locations outwardly of flange 34, while a pair of threaded bores 42 extend through flange 34 radially of the curved outer side surface 36 of the flange. A fifth bore 44 extends through connector base 30 near its inner end to provide a means for connecting an electrical current supply line (not shown) to the connector. Thus, a line 20*a* connects via a terminal secured in each of the three bores 44 to a three phase power supply.

Referring now particularly to FIG. 6, there is shown a detail of the manner in which a connector 30 is employed and attached to two adjacent shell segments such as 28*a* and 28*c* to assemble the two segments to each other. Each of the segments 28*a* and 28*c* has a vertically extending threaded bore 46 which will receive graphite screws 48 seated in bores 40 in the connector 30. Also, each of segments 28*a* and 28*c* is formed with a radially extending bore 50 which will receive a screw 52 which passes through the cylindrical shell segment and is threaded into the tapped bores 42 in the flange of connector 30.

This arrangement finds the three cylindrical segments 28*a*, 28*b*, and 28*c* detachably assembled to each other with the individual segments truly concentric about a common central axis, with the spacing between adjacent segments as at the slots 22' being equal to the width of the remaining slots 22 and 26, and with the cross-sectional area to current flow presented by connector 30 corresponding to that presented by the unslotted portions of the individual segments. Thus, the dimension x in FIG. 5 is substantially the dimension x in FIG. 3, and the width and length of part 34 being chosen to provide a cross-sectional area which provides a resistance heat output at the connector 30 connected pickets similar to that of the other integrated heater pickets. Cracking or chipping of one of the expensive individual segments 22*a*, etc. requires only that that individual segment be replaced, and does not require the scrapping of the entire heating element.

While one embodiment of the invention has been described, it will be apparent to those skilled in the art that the disclosed embodiment may be modified. Therefore the foregoing description is to be considered exemplary rather than limiting, and the true scope of the invention is that defined in the following claims.

What is claimed is:

1. The method of making a zig-zag picket-type graphite heater element having an upper end and a lower end, comprising the steps of: forming a hollow cylindrical, graphite shell with axially extending slots through the wall of said shell, at uniformly circumferentially spaced locations, alternately from opposite ends of said shell to a length less than the length of the shell to form zig-zag pickets around the circumference of the shell; extending a plurality of said slots, at uniformly spaced locations about the circumference, the entire length of the shell to an end thereof, to divide the shell into a plurality of like arcuate, discrete, zig-zag picket segments; assembling said segments in cylindrical form by rigidly mechanically connecting them with discrete graphite connector elements having base portions with projecting flange portions, which abut and secure pairs of adjacent segments together in a spaced apart relation wherein their circumferential spacing is substantially the circumferential width of the slots so as to form a rigid cylindrical shell having uniform electric current flow characteristics, the connector elements bridging the spacing between adjacent segments at the lower end of the heater element; and electrically connecting said base portions of the discrete graphite connector elements to permit the application of an electrical current to said pickets via said connector elements.

2. The method of claim 1 wherein said segments have n slots extending from one end thereof, and n+1 slots extending from the other end.

* * * * *